United States Patent [19]

Grim

[11] 4,352,216

[45] Oct. 5, 1982

[54] PERMANENT WAVE HEADREST ATTACHMENT

[76] Inventor: Dale D. Grim, 511 Stanley St., Perry, Ga. 31069

[21] Appl. No.: 183,213

[22] Filed: Sep. 2, 1980

[51] Int. Cl.[3] ..... A47K 3/12

[52] U.S. Cl. ..... 4/523; 4/575

[58] Field of Search ..... 4/515, 516, 519, 523, 4/575

[56] References Cited

U.S. PATENT DOCUMENTS

| | | | |
|---|---|---|---|
| 1,163,945 | 12/1915 | Murdock | 4/575 |
| 1,806,103 | 5/1931 | Tyler | 4/575 |
| 2,013,823 | 9/1935 | Chancer | 4/523 X |
| 2,172,589 | 9/1939 | Middleton | 4/523 |
| 2,505,252 | 4/1950 | Langley | 4/575 X |
| 2,527,868 | 10/1950 | Wilson | 4/523 |
| 2,948,903 | 8/1960 | Gilmer | 4/523 |
| 3,026,537 | 3/1962 | Schnell | 4/523 X |
| 4,215,443 | 8/1980 | Babik | 4/DIG. 5 |

FOREIGN PATENT DOCUMENTS

| | | | |
|---|---|---|---|
| 833105 | 3/1952 | Fed. Rep. of Germany | 4/575 |

*Primary Examiner*—Charles E. Phillips

*Attorney, Agent, or Firm*—Newton, Hopkins & Ormsby

[57] ABSTRACT

To relieve pressure on the back of the neck during two lengthy rinse periods in the permanent wave cycle, a head support of open mesh material supports the head over the center of the lavatory thereby promoting comfort during normally uncomfortable periods.

1 Claim, 6 Drawing Figures

PERMANENT WAVE HEADREST ATTACHMENT

BACKGROUND OF THE INVENTION

The present invention seeks to fulfill a particular need which is not satisfied by any known prior art device. Normally, during the permanent waving process, and while the perm rods are in the hair, the hair must be rinsed during two periods of about five minutes each. During these long rinses, the neck of the subject rests within a built-in depression in the front wall of the lavatory and the unsupported head extends over the well of the lavatory. The resulting pressure on the back of the neck can be extremely uncomfortable during these rather long rinse periods.

The prupose of the present invention is to relieve the uncomfortable pressure on the back of the neck through the adequate support of the subject's head, thereby distributing the pressure to the skull.

An object of the invention is to accomplish the above without impeding drainage of the rinse water.

Another object is to provide a head support of the mentioned type which attaches easily and adjustably to any lavatory or sink in a beauty shop.

Another object is to provide a support attachment for the stated purpose which is lightweight and inexpensive and very easy to install.

Other features and advantages of the invention will become apparent during the course of the following description.

DETAILED DESCRIPTION

Figure 1:
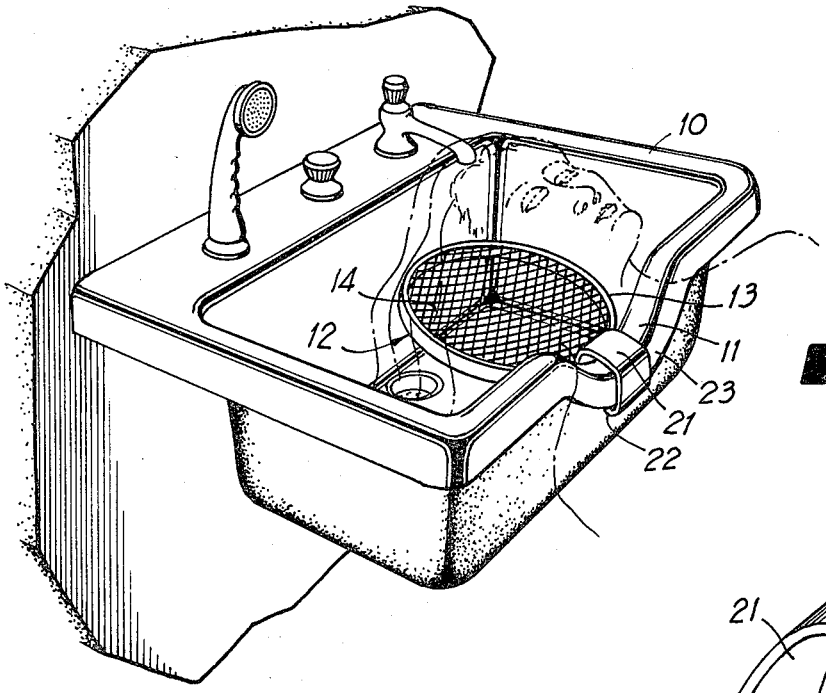
FIG. 1 is a perspective view of a permanent wave headrest according to the invention.
Figure 2:
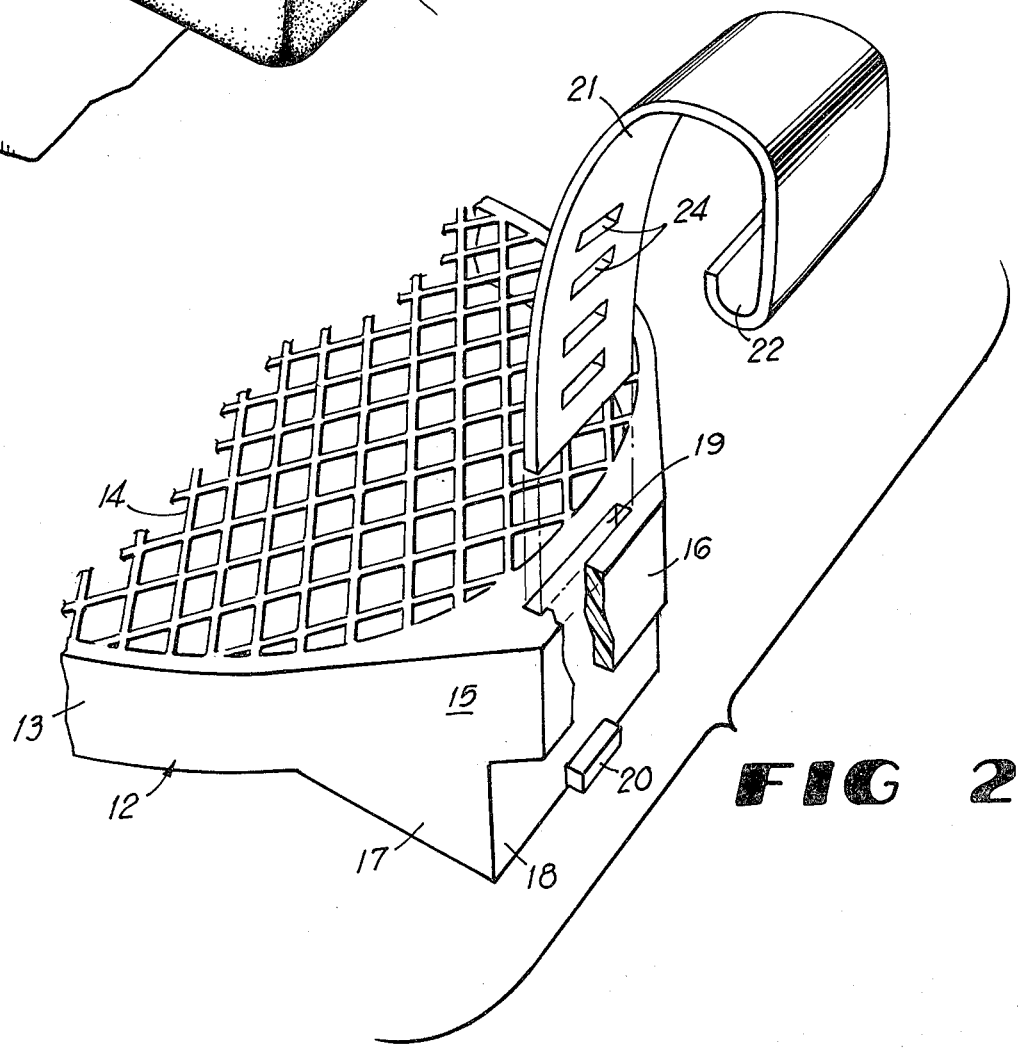
FIG. 2 is an enlarged fragmentary exploded perspective view of the same, partly broken away.
Figure 3:
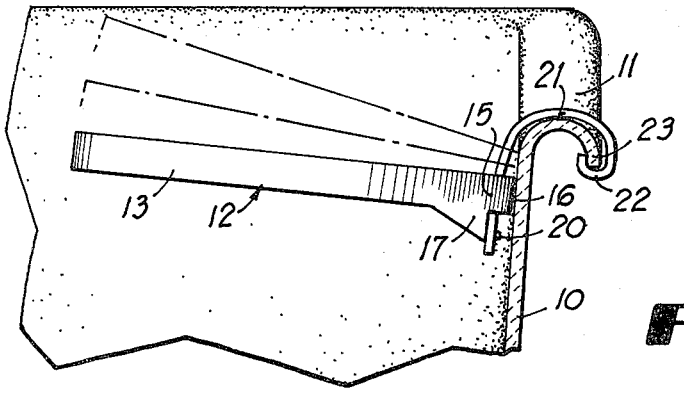
FIG. 3 is a side elevational view of the headrest in its use position.

Referring first to FIGS. 1 through 3 of the drawings in detail, wherein like numerals designate like parts, a conventional beauty parlor lavatory 10 has a front wall neck depression 11 in which the neck of a subject undergoing lengthy hair rinsing during the permanent wave process rests. The head is unsupported at this time and is cantilivered over the well of the lavatory, and the heavy pressure on the back of the neck during two five minute rinse periods can become quite painful.

To alleviate this discomfort, a headrest attachment 12 according to the invention is preferably formed entirely of plastics material and comprises an oval or circular frame 13, the top of which is spanned by a thin open mesh panel 14 preferably formed integral with the frame 13. The open mesh panel 14 is comparatively rigid to support the weight of the head and the multiple openings formed therethrough are quite large as illustrated to facilitate the drainage of rinse water. As shown in FIG. 1, the head of the subject is comfortably supported over the center of the lavatory well with the neck relieved substantially of all uncomfortable pressure. As shown in FIG. 3, the support is approximately horizontal during use and inclined slightly upwardly away from the front wall 10.

At its forward end, the frame 13 has an enlarged boss 15 formed thereon including a transverse vertical end face 16 and a depending integral tapered extension 17 having a forwardly offset vertical face 18. A vertical slot 19 is formed through the boss 15 and a single locking lug 20 is formed on the vertical face 18 near the bottom thereof and directly below the slot 19.

A suspension element 21 in the nature of a rigid strap hanger formed of plastics material is provided, and includes a terminal hook 22 for easy engagement with a forward flange 23 of the lavatory 10 at the center of the neck recess 11.

The body portion of the strap hanger 21 has multiple apertures 24 formed therethrough and adapted selectively to receive the locking lug 20 when the strap hanger is inserted in the slot 19 so that the headrest is rendered vertically adjustable on the lavatory. The vertical face 12 bears against the strap hanger 21, FIG. 3, and the projecting face 16 bears against the interior of the lavatory front wall to render the device stable during use. The open mesh panel 14 is a thin panel disposed in a plane flush with the top of the frame 13 which is comparatively deep vertically for rigidity.

Figure 4:
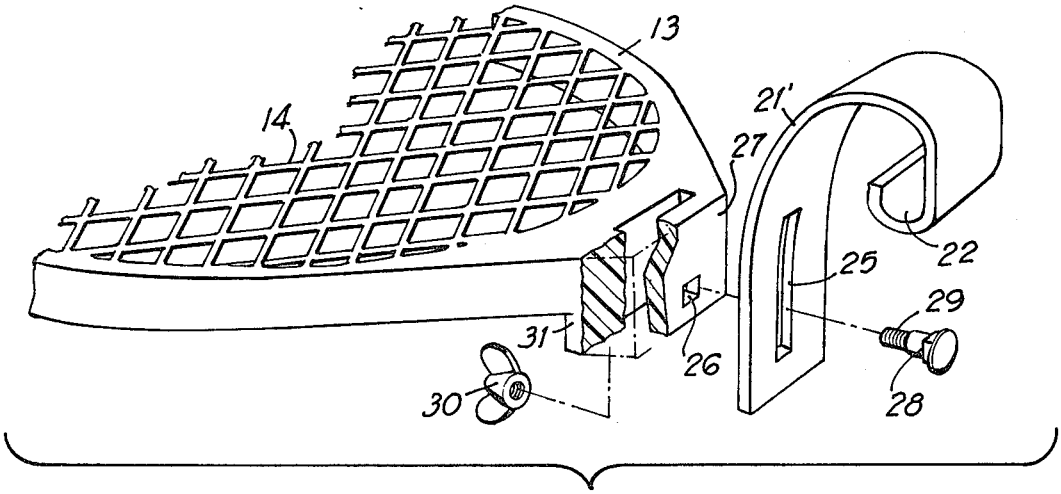
FIG. 4 is a fragmentary exploded perspective view of the headrest according to a variation of the invention.

A variant of the invention is shown in FIG. 4 wherein a strap hanger 21' for the device has a vertical slot 25 in lieu of the apertures 24. A square opening 26 in the end face 27 of the head rest receives a square shoulder 28 of a clamping screw 29 which receives a locking nut 30 behind the enlargement or boss 31. In this manner, the hanger 21' is rendered vertically adjustable and lockable. The remainder of the structure is as described relative to FIGS. 1 through 3.

Figure 5:
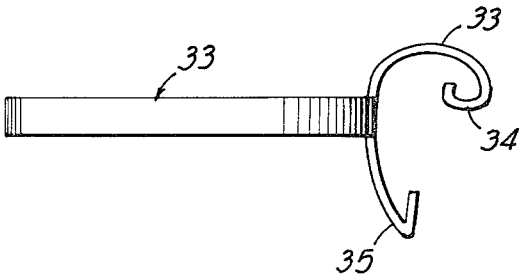
FIGS. 5 and 6 are side elevational views of headrests in accordance with modifications of the invention.

FIG. 5 shows a simplified form of headrest attachment wherein the body portion 32 thereof is of the same basic construction as shown in FIGS. 1 to 4. In lieu of the vertically adjustable hangers 21 or 21', a fixed suspension element 33 on the device has a hook terminal 34 to engage the lavatory flange 23, and an integral bottom brace 35 to bear upon the interior of the front wall of the lavatory during use.

Figure 6:
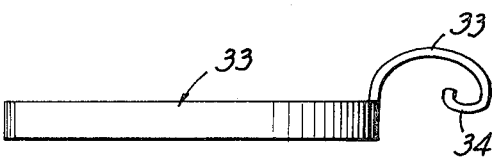

In FIG. 6, a further simplified form of the device is illustrated wherein the bottom brace 35 is eliminated and only the upper portion of the suspension element 33 with flange-engaging hook 34 is provided.

The invention in all forms is very lightweight and characterized by simplicity of construction, convenience of use, and economy of manufacturing. Its use completely alleviates the discomfort involved during the rinsing of hair in the permanent wave process, which problem has not been alleviated in the prior art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A two part permanent wave headrest attachment for a sink comprising a one part foraminous panel adapted to bear the weight of the head of a subject with the head substantially centered over the well of the sink, so as to relieve uncomfortable pressure from the back of a subject's neck during rinsing, said panel being approximately horizontal during use, the forward end of the panel having an integral depending extension including a substantially vertical surface to bear against the interior of the sink front wall, and said extension having a substantially vertical slot formed therethrough substantially at right angles to the plane of said panel, a one part hanger element for the headrest formed separately from the panel and having a substantially vertical portion engageable adjustably through said slot and an upper terminal hook portion adapted to engage a forward flange of the sink, and cooperating means integral with said panel and said hanger respectively for adjustably securing said substantially vertical portion of the hanger element in said slot at different selected positions, said cooperating adjusting means comprising a projection on said extension in alignment with said vertical slot and cooperative spaced recessed portions in the substantially vertical portion of said hanger that are adapted to receive selectively said projection.

* * * * *